US009393811B2

(12) United States Patent
Yoshida et al.

(10) Patent No.: US 9,393,811 B2
(45) Date of Patent: Jul. 19, 2016

(54) APPARATUS FOR AND METHOD OF RECORDING IMAGE

(71) Applicant: SCREEN HOLDINGS CO., LTD., Kyoto (JP)

(72) Inventors: Mitsuhiro Yoshida, Kyoto (JP); Takashi Kamigiku, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/925,143

(22) Filed: Oct. 28, 2015

(65) Prior Publication Data

US 2016/0121627 A1 May 5, 2016

(30) Foreign Application Priority Data

Oct. 31, 2014 (JP) ..... 2014-222198

(51) Int. Cl.
*B41J 29/393* (2006.01)
*B41J 11/00* (2006.01)

(52) U.S. Cl.
CPC ..... *B41J 11/0025* (2013.01)

(58) Field of Classification Search
CPC .... B41J 13/0009; B41J 11/001; B41J 11/003; B41J 2/04505
See application file for complete search history.

(56) References Cited

U.S. PATENT DOCUMENTS

| | | | | |
|---|---|---|---|---|
| 6,364,556 | B1 * | 4/2002 | Barbera | B65H 7/125 271/262 |
| 9,128,651 | B2 * | 9/2015 | Kameda | G06F 3/125 |
| 2003/0116042 | A1 | 6/2003 | Ohba et al. | |
| 2008/0122889 | A1 | 5/2008 | Naoi et al. | |
| 2010/0201732 | A1 | 8/2010 | Naoi et al. | |
| 2012/0240803 | A1 | 9/2012 | Sato et al. | |

FOREIGN PATENT DOCUMENTS

| | | | |
|---|---|---|---|
| JP | 2003-182896 | A | 7/2003 |
| JP | 2006-091384 | A | 4/2006 |
| JP | 2008-155628 | A | 7/2008 |
| JP | 2011-230417 | A | 11/2011 |
| JP | 2012-201419 | A | 10/2012 |
| JP | 2014-189337 | A | 10/2014 |
| JP | 5772121 | B2 | 9/2015 |

OTHER PUBLICATIONS

European Search Report EP Application No. 15 19 0111.3 dated Apr. 7, 2016.

* cited by examiner

*Primary Examiner* — Lamson Nguyen
(74) *Attorney, Agent, or Firm* — McDermott Will & Emery LLP

(57) ABSTRACT

In an image recording apparatus, edge sensors are disposed in front of and behind a recording position on a transport path of printing paper. The edge sensors detect a widthwise position of the printing paper in respective positions upstream and downstream of the recording position. A controller in the image recording apparatus calculates the widthwise position of the printing paper in the recording position, based on detection results from the edge sensors. Thus, the widthwise position of the printing paper in the recording position is identified without the placement of an edge sensor in the recording position on the transport path.

20 Claims, 6 Drawing Sheets

APPARATUS FOR AND METHOD OF RECORDING IMAGE

CROSS-REFERENCE TO RELATED APPLICATIONS

This Application claims priority to Japanese Patent Application No. 2014-222198 filed Oct. 31, 2014, the subject matter of which is incorporated herein by reference in entirety.

BACKGROUND OF THE INVENTION

1. Field of the Invention

The present invention relates to an image recording apparatus and an image recording method which record an image on an elongated strip-shaped recording medium while transporting the recording medium.

2. Description of the Background Art

An inkjet image recording apparatus which records an image on elongated strip-shaped printing paper by ejecting ink from a plurality of recording heads while transporting the printing paper has heretofore been known. In the image recording apparatus of this type, inks of different colors are ejected from the respective recording heads. A multicolor image is recorded on a surface of the printing paper by superimposing single-color images formed by the respective color inks. The image recording apparatus of this type includes a detection mechanism for detecting a widthwise position (position as seen in a width direction) of the printing paper at all times for the purpose of controlling the position of ejection of ink with respect to the printing paper.

Such a conventional image recording apparatus including the detection mechanism is disclosed, for example, in Japanese Patent Application Laid-Open No. 2008-155628 and Japanese Patent Application Laid-Open No. 2003-182896. The apparatus disclosed in Japanese Patent Application Laid-Open No. 2008-155628 uses a plurality of line image sensors to detect the angle of skew of a recording medium, thereby adjusting the timing of ink ejection in accordance with the detected angle of skew (with reference to claims 1 and 2 and FIG. 1). The apparatus disclosed in Japanese Patent Application Laid-Open No. 2003-182896 includes two or more sensors for detecting edges of paper, and feeds a difference between outputs from the sensors where a constant time difference is established back to a correcting part (with reference to claim 1 and FIG. 1).

Unfortunately, the image recording positions of the recording heads and the detection positions of the sensors are different on a transport path of the printing paper in the apparatuses disclosed in Japanese Patent Application Laid-Open No. 2008-155628 and Japanese Patent Application Laid-Open No. 2003-182896. In the configurations of these apparatuses, the widthwise position of the printing paper in the recording position accordingly does not precisely coincide with the detection result obtained from each sensor. For recording of an image of higher quality, it is necessary to identify the widthwise position of the printing paper in the image recording position. However, the recording heads are disposed in the recording positions of the printing paper. For this reason, it is often difficult in terms of space to place the sensors in addition to the recording heads in the recording positions. In particular, the space for the placement of the sensors is more limited in an apparatus which records an image across the full width of printing paper.

SUMMARY OF THE INVENTION

It is therefore an object of the present invention to provide a technique for identifying a widthwise position of a recording medium in a recording position without the placement of a detector in the recording position lying on a transport path in an image recording apparatus which records an image while transporting the recording medium.

A first aspect of the present invention is intended for an image recording apparatus comprising: a transport mechanism for transporting an elongated strip-shaped recording medium in a longitudinal direction thereof along a predetermined transport path; at least one recording head for recording an image on a surface of the recording medium in a recording position on the transport path; an upstream detector for detecting a widthwise position of the recording medium in a position upstream of the recording position on the transport path; a downstream detector for detecting the widthwise position of the recording medium in a position downstream of the recording position on the transport path; and a calculation part for calculating the widthwise position of the recording medium in the recording position, based on detection results from the upstream detector and the downstream detector.

A second aspect of the present invention is intended for a method of recording an image on a surface of an elongated strip-shaped recording medium in a recording position on a predetermined transport path while transporting the recording medium in a longitudinal direction thereof along the transport path. The method comprises the steps of: a) detecting a widthwise position of the recording medium in a position upstream of the recording position on the transport path, and detecting the widthwise position of the recording medium in a position downstream of the recording position on the transport path; and b) calculating the widthwise position of the recording medium in the recording position, based on detection results obtained in step a).

According to the first aspect of the present invention, the widthwise position of the recording medium in the recording position is calculated based on the detection results from the two detectors disposed in front of and behind the recording position. Thus, the widthwise position of the recording medium in the recording position is identified without the placement of a detector in the recording position on the transport path.

According to the second aspect of the present invention, the widthwise position of the recording medium in the recording position is calculated based on the detection results in front of and behind the recording position. Thus, the widthwise position of the recording medium in the recording position is identified without the placement of a detector in the recording position on the transport path.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings.

<1. Configuration of Image Recording Apparatus>

Figure 1:
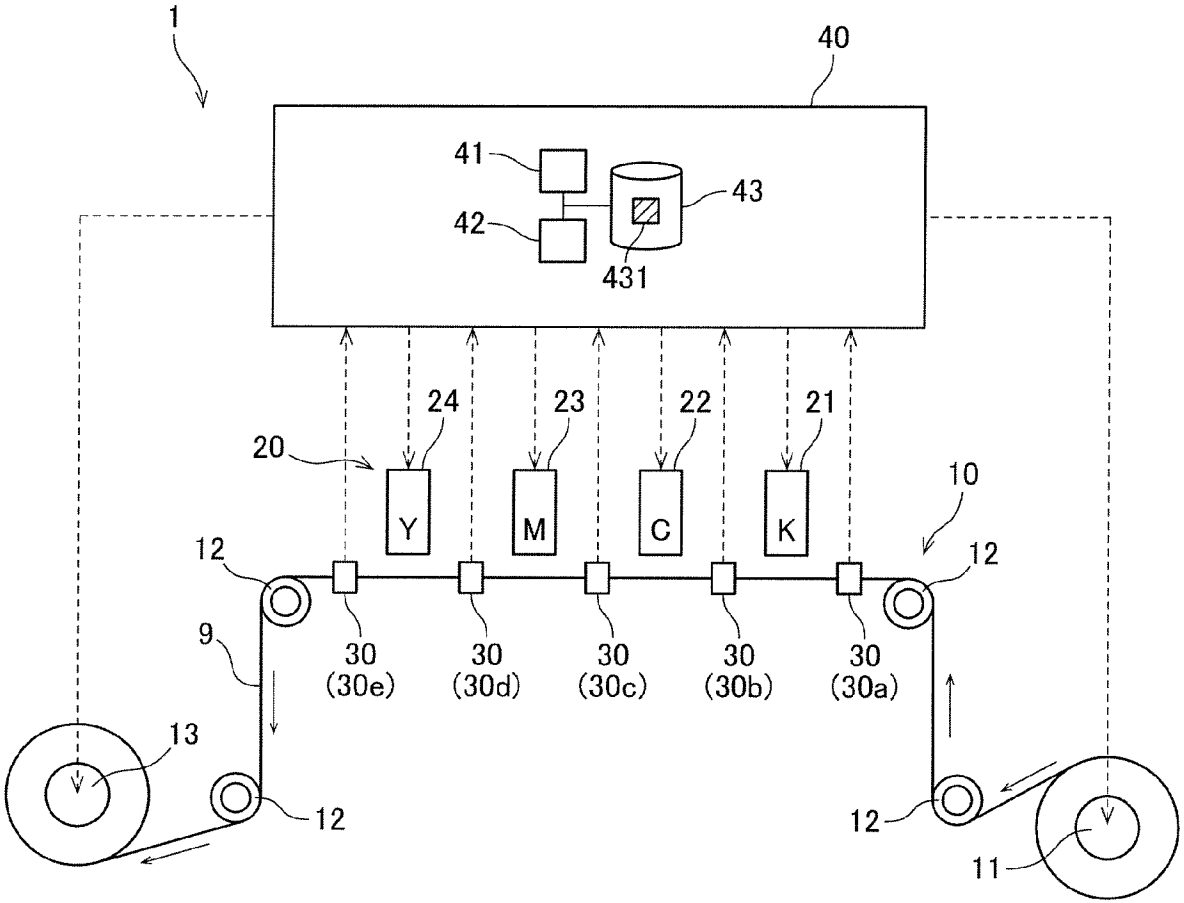
FIG. 1 is a view showing a configuration of an image recording apparatus.

FIG. 1 is a view showing a configuration of an image recording apparatus 1 according to one preferred embodiment of the present invention. This image recording apparatus 1 is an inkjet printing apparatus. The image recording apparatus 1 records a multicolor image on printing paper 9 that is an elongated strip-shaped recording medium by ejecting ink from a plurality of recording heads 21 to 24 toward the printing paper 9 while transporting the printing paper 9. As shown in FIG. 1, the image recording apparatus 1 includes a transport mechanism 10, an image recorder 20, a plurality of edge sensors 30, and a controller 40.

The transport mechanism 10 is a mechanism for transporting the printing paper 9 in a transport direction along the length of the printing paper 9. The transport mechanism 10 according to the present preferred embodiment includes an unwinder 11, a plurality of transport rollers 12, and a winder 13. The printing paper 9 is unwound from the unwinder 11, and is transported along a transport path formed by the transport rollers 12. Each of the transport rollers 12 rotates about a horizontal axis to guide the printing paper 9 downstream along the transport path. The transported printing paper 9 is wound and collected on the winder 13.

As shown in FIG. 1, the printing paper 9 is moved under the image recorder 20 in substantially parallel relation to a direction in which the recording heads 21 to 24 are arranged. During this movement, a recording surface of the printing paper 9 faces upwardly (toward the recording heads 21 to 24). The printing paper 9 runs over the transport rollers 12 while being held under tension. This prevents slack and wrinkles in the printing paper 9 during the transport.

The image recorder 20 ejects ink droplets toward the printing paper 9 transported by the transport mechanism 10. The image recorder 20 according to the present preferred embodiment includes a first recording head 21, a second recording head 22, a third recording head 23 and a fourth recording head 24 which are equally spaced along the transport path of the printing paper 9.

Figure 2:
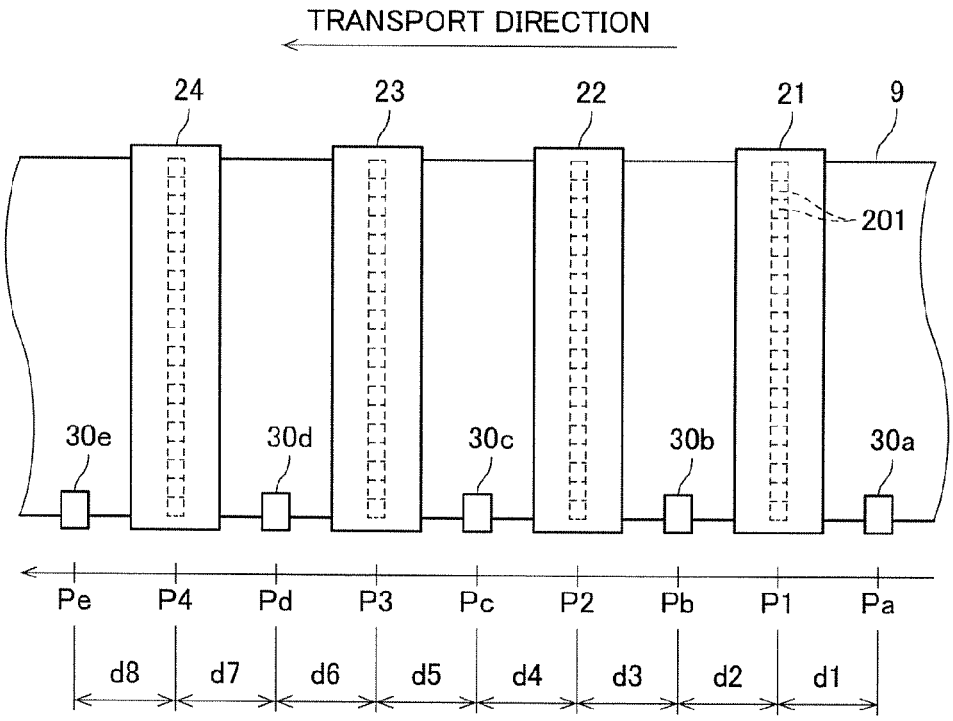
FIG. 2 is a partial top plan view of the image recording apparatus, and shows an image recorder and its surroundings.

FIG. 2 is a partial top plan view of the image recording apparatus 1, and shows the image recorder 20 and its surroundings. As indicated by broken lines in FIG. 2, a lower surface of each of the recording heads 21 to 24 includes a plurality of nozzles 201 arranged parallel to a width direction of the printing paper 9. The "width direction" refers to a horizontal direction orthogonal to the transport direction. The first, second, third and fourth recording heads 21, 22, 23 and 24 eject ink droplets of four colors, i.e., K (black), C (cyan), M (magenta) and Y (yellow), respectively, which serve as color components of a multicolor image from the nozzles 201 toward an upper surface of the printing paper 9.

Specifically, the first recording head 21 ejects K-color ink droplets toward the upper surface of the printing paper 9 in a first recording position P1 lying on the transport path. The second recording head 22 ejects C-color ink droplets toward the upper surface of the printing paper 9 in a second recording position P2 downstream of the first recording position P1. The third recording head 23 ejects M-color ink droplets toward the upper surface of the printing paper 9 in a third recording position P3 downstream of the second recording position P2. The fourth recording head 24 ejects Y-color ink droplets toward the upper surface of the printing paper 9 in a fourth recording position P4 downstream of the third recording position P3. In the present preferred embodiment, the first recording position P1, the second recording position P2, the third recording position P3 and the fourth recording position P4 are equally spaced in the transport direction of the printing paper 9.

Each of the four recording heads 21 to 24 ejects ink droplets to thereby record a single-color image on the upper surface of the printing paper 9. A multicolor image is formed on the upper surface of the printing paper 9 by superimposing the four single-color images. If the widthwise positions (positions as seen in the width direction) of the ink droplets ejected from the four recording heads 21 to 24 on the printing paper 9 do not coincide with each other, the image quality of a printed product is lowered. Controlling such misregistration between the single-color images on the printing paper 9 within an allowable range is an important factor for improvements in print quality of the image recording apparatus 1.

A dryer unit for drying the ink ejected onto the recording surface of the printing paper 9 may be further provided downstream of the recording heads 21 to 24 as seen in the transport direction. The dryer unit, for example, blows a heated gas toward the printing paper 9 to vaporize a solvent contained in the ink adhering to the printing paper 9, thereby drying the ink. The dryer unit may be of the type which dries the ink by other methods such as irradiation with light.

The edge sensors 30 are sensors for detecting the widthwise position of the printing paper 9. In the present preferred embodiment, the edge sensors 30 are provided in five locations: upstream of the first recording position P1 on the transport path, between the four recording positions P1 to P4, and downstream of the fourth recording position P4. The five edge sensors 30 are referred to as first, second, third, fourth and fifth edge sensors 30*a*, 30*b*, 30*c*, 30*d* and 30*e* arranged in order as seen from upstream.

As shown in FIG. 2, the first edge sensor 30*a* is disposed in a first detection position Pa upstream of the first recording position P1. The second edge sensor 30*b* is disposed in a second detection position Pb between the first recording position P1 and the second recording position P2. The third edge sensor 30*c* is disposed in a third detection position Pc between the second recording position P2 and the third recording position P3. The fourth edge sensor 30*d* is disposed in a fourth detection position Pd between the third recording position P3 and the fourth recording position P4. The fifth edge sensor 30*e* is disposed in a fifth detection position Pe downstream of the fourth recording position P4.

Figure 3:
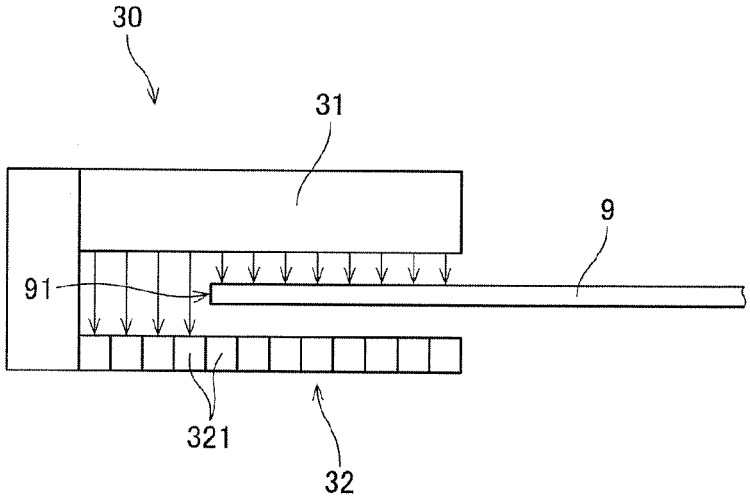
FIG. 3 is a view schematically showing a structure of edge sensors.

FIG. 3 is a view schematically showing a structure of the edge sensors 30. As shown in FIG. 3, each of the edge sensors 30 includes a light emitter 31 positioned over an edge 91 of the printing paper 9, and a line sensor 32 positioned under the edge 91. The light emitter 31 emits parallel light beams downwardly. The line sensor 32 includes a plurality of light receiving elements 321 arranged in the width direction. Outside the edge 91 of the printing paper 9, light beams emitted from the light emitter 31 enter the light receiving elements 321, so that the light receiving elements 321 detect the light beams, as shown in FIG. 3. Inside the edge 91 of the printing paper 9, light beams emitted from the light emitter 31 are intercepted by the printing paper 9, so that the light receiving elements 321 detect no light beams. The edge sensors 30 detect the position of the edge 91 of the printing paper 9, based on whether the light receiving elements 321 detect light beams or not.

The controller 40 is a component for controlling the operations of the components in the image recording apparatus 1. As conceptually shown in FIG. 1, the controller 40 includes a computer having an arithmetic processor 41 such as a CPU, a memory 42 such as a RAM, and a storage part 43 such as a hard disk drive. A computer program 431 for executing a printing process while detecting and correcting the widthwise position of the printing paper 9 is installed in the storage part 43. As indicated by broken lines in FIG. 1, the controller 40 is electrically connected to the transport mechanism 10, the four recording heads 21 to 24 and the five edge sensors 30*a* to 30*e* described above. The controller 40 temporarily reads the computer program 431 stored in the storage part 43 onto the memory 42. The arithmetic processor 41 performs arithmetic processing based on the computer program 431, so that the controller 40 controls the operations of the aforementioned components. Thus, the printing process in the image recording apparatus 1 proceeds.

<2. Meandering Detection and Correction Process>

As mentioned above, this image recording apparatus 1 records an image on the surface of the printing paper 9 while transporting the printing paper 9. To suppress the aforementioned misregistration between the single-color images at this time, the image recording apparatus 1 detects the widthwise positions of the printing paper 9 in the four recording positions P1 to P4 (meandering detection) to correct the ejection positions of ink droplets toward the printing paper 9 in the four recording positions P1 to P4. The details of the meandering detection and the correction process will be described below.

Figure 4:
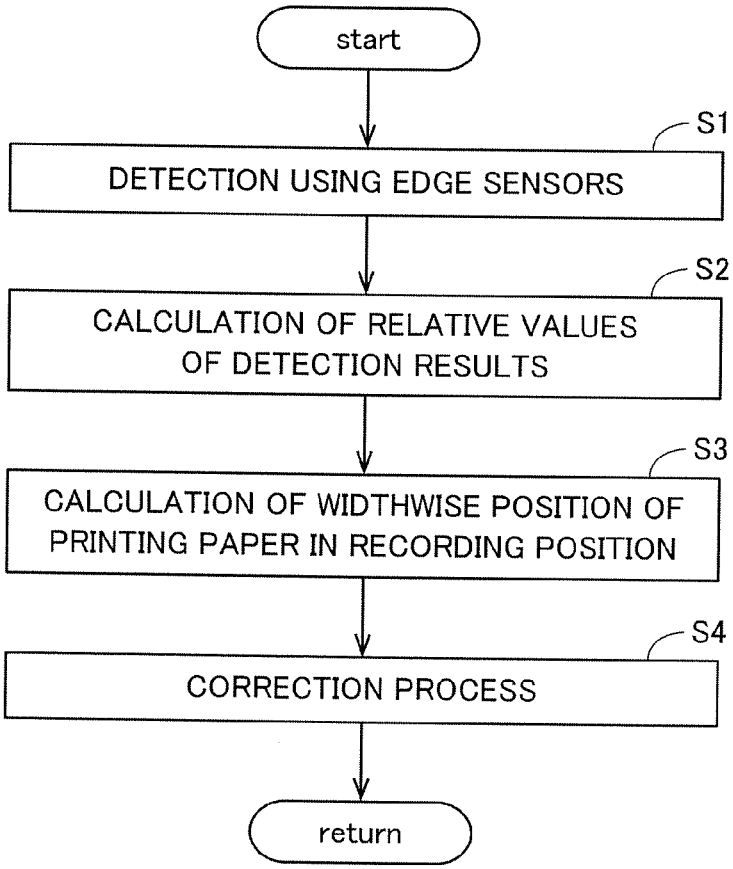
FIG. 4 is a flow diagram showing a procedure for meandering detection and a correction process.

FIG. 4 is a flow diagram showing a procedure for the meandering detection and the correction process in the image recording apparatus 1. During the recording of an image on the printing paper 9, the image recording apparatus 1 repeatedly performs the procedure shown in FIG. 4 while transporting the printing paper 9 along the transport path.

When the transport of the printing paper 9 is started, the image recording apparatus 1 initially starts a detection process by means of the five edge sensors 30*a* to 30*e* (Step S1). The five edge sensors 30*a* to 30*e* continuously detect the widthwise positions of the printing paper 9 in the respective detection positions Pa to Pe. Thus, the widthwise positions of the printing paper 9 are acquired as information changing with time (time-series information) in the detection positions Pa to Pe.

The first edge sensor 30*a* detects the widthwise position of the printing paper 9 in the first detection position Pa upstream of the first recording position P1 on the transport path. That is, the first edge sensor 30*a* serves as an upstream detector for the first recording position P1 in the present preferred embodiment. Similarly, the second edge sensor 30*b*, the third edge sensor 30*c* and the fourth edge sensor 30*d* serve as upstream detectors for the second recording position P2, the third recording position P3 and the fourth recording position P4, respectively. In this manner, the upstream detectors are provided for the four respective recording positions P1 to P4 in the present preferred embodiment. The controller 40 treats detection results obtained from the four edge sensors 30*a* to 30*d* as detection results from the upstream detectors for the four recording positions P1 to P4, respectively.

The second edge sensor 30*b* detects the widthwise position of the printing paper 9 in the second detection position Pb downstream of the first recording position P1 on the transport path. That is, the second edge sensor 30*b* serves as a downstream detector for the first recording position P1 in the present preferred embodiment. Similarly, the third edge sensor 30*c*, the fourth edge sensor 30*d* and the fifth edge sensor 30*e* serve as downstream detectors for the second recording position P2, the third recording position P3 and the fourth recording position P4, respectively. In this manner, the downstream detectors are provided for the four respective recording positions P1 to P4 in the present preferred embodiment. The controller 40 treats detection results obtained from the four edge sensors 30*b* to 30*e* as detection results from the downstream detectors for the four recording positions P1 to P4, respectively.

Of the five edge sensors 30*a* to 30*e* in the image recording apparatus 1, the second edge sensor 30*b*, the third edge sensor 30*c* and the fourth edge sensor 30*d* function both as upstream detectors and as downstream detectors. Specifically, the second edge sensor 30*b* functions both as the downstream detector for the first recording position P1 and as the upstream detector for the second recording position P2. The third edge sensor 30*c* functions both as the downstream detector for the second recording position P2 and as the upstream detector for the third recording position P3. The fourth edge sensor 30*d* functions both as the downstream detector for the third recording position P3 and as the upstream detector for the fourth recording position P4.

In this manner, the upstream and downstream detectors to be disposed between the recording positions P1 to P4 are implemented by each single edge sensor 30. This achieves the reduction in the number of edge sensors 30 required.

Of the five edge sensors 30*a* to 30*e*, the four edge sensors 30*b* to 30*e* serving as the downstream detectors start performing the detection process on a portion of the printing paper 9 which is downstream of a region on which an image is to be recorded. Then, the four edge sensors 30*b* to 30*e* always detect the widthwise positions of the portion of the printing paper 9 which is downstream of a portion (target portion) on which an image is to be recorded. This enables the process in Steps S2 to S4 to be described later to correct the meandering of the printing paper 9 before the target portion of the printing paper 9 reaches the recording positions P1 to P4.

The detection results from the five edge sensors 30*a* to 30*e* are sent to the controller 40. Upon receipt of the detection results, the controller 40 calculates relative values of the detection results from the three following upstream detectors (second to fourth edge sensors 30*b* to 30*d*) relative to the detection result from the leading upstream detector (first edge sensor 30*a*), and relative values of the detection results from the three following downstream detectors (third to fifth edge sensor 30*c* to 30*e*) relative to the detection result from the leading downstream detector (second edge sensor 30*b*) (Step S2).

Figure 5:
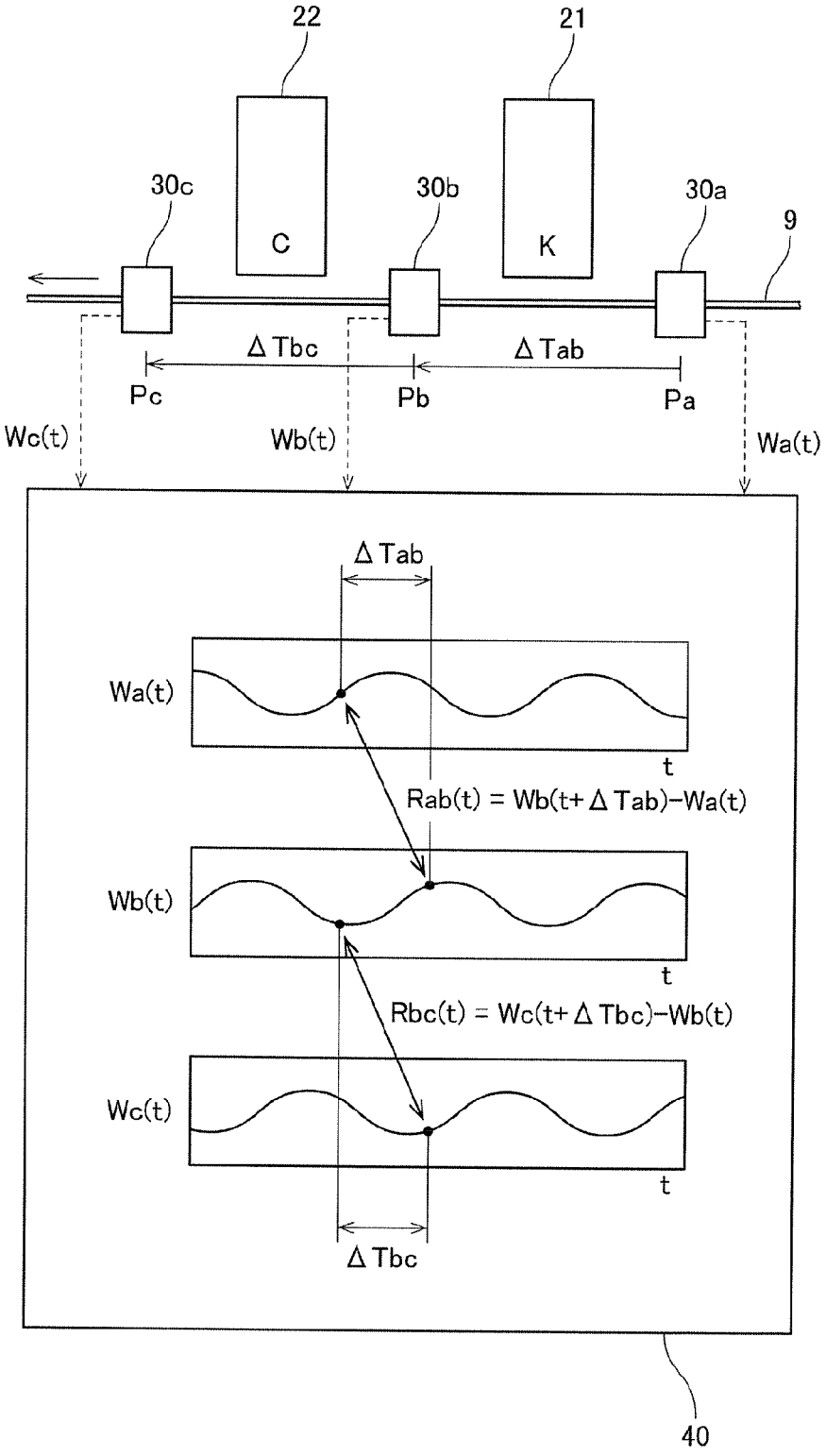
FIG. 5 is a view conceptually showing a relative value calculation process.

FIG. 5 is a view conceptually showing the process of calculating the relative values in Step S2. An example of the calculation of the relative value of the detection result from the second edge sensor 30*b* serving as the following upstream detector relative to the detection result from the first edge sensor 30*a* serving as the leading upstream detector, and the relative value of the detection result from the third edge sensor 30*c* serving as the following downstream detector relative to the detection result from the second edge sensor 30*b* serving as the leading downstream detector is shown in FIG. 5.

The detection results obtained from the first edge sensor 30*a*, the second edge sensor 30*b* and the third edge sensor 30*c* at time t are denoted by Wa(t), Wb(t) and Wc(t), respectively. Transport time required to transport the printing paper 9 from the first detection position Pa to the second detection position Pb is denoted by ΔTab, and transport time required to transport the printing paper 9 from the second detection position Pb to the third detection position Pc is denoted by ΔTbc.

First, a method of calculating the relative value of the detection result from the second edge sensor 30*b* serving as the following upstream detector relative to the detection result from the first edge sensor 30*a* serving as the leading upstream detector will be described. The controller 40 makes a comparison between the detection result Wa(t) obtained from the first edge sensor 30*a* and the detection result Wb(t+ΔTab) obtained from the second edge sensor 30*b* at a time later by the amount ΔTab. Then, a relative value Rab(t) therebetween is calculated, for example, by $$Rab(t)=Wb(t+\Delta Tab)-Wa(t) \quad (1)$$

In this manner, the controller 40 compares the detection result Wa(t) in the first detection position Pa and the detection result Wb(t) in the second detection position Pb at times different by the amount of transport time ΔTab of the printing paper 9 between the detection positions Pa and Pb, rather than at the same time. This achieves the comparison between the results of detection of the same portion of the printing paper 9 which are obtained from the first edge sensor 30*a* and the second edge sensor 30*b*. Thus, if an edge itself of the printing paper 9 has small irregularities, the controller 40 is capable of calculating the amount of displacement of the printing paper 9 in the width direction between the detection positions Pa and Pb while eliminating the influence of the irregularities. As a result, the relative value Rab(t) indicating how much the printing paper 9 is displaced in the width direction between the first detection position Pa and the second detection position Pb is obtained accurately.

The controller 40 also calculates relative values Rac(t) and Rad(t) of the detection results from the third edge sensor 30*c* and the fourth edge sensor 30*d* which serve as the following upstream detectors relative to the detection result from the first edge sensor 30*a* serving as the leading upstream detector by a similar method.

Next, a method of calculating the relative value of the detection result from the third edge sensor 30*c* serving as the following downstream detector relative to the detection result from the second edge sensor 30*b* serving as the leading downstream detector will be described. The controller 40 makes a comparison between the detection result Wb(t) obtained from the second edge sensor 30*b* and the detection result Wc(t+ΔTbc) obtained from the third edge sensor 30*c* at a time later by the amount ΔTbc. Then, a relative value Rbc(t) therebetween is calculated, for example, by $$Rbc(t)=Wc(t+\Delta Tbc)-Wb(t) \quad (2)$$

In this manner, the controller 40 compares the detection result Wb(t) in the second detection position Pb and the detection result Wc(t) in the third detection position Pc at times different by the amount of transport time ΔTbc of the printing paper 9 between the detection positions Pb and Pc, rather than at the same time. This achieves the comparison between the results of detection of the same portion of the printing paper 9 which are obtained from the second edge sensor 30*b* and the third edge sensor 30*c*. Thus, if an edge itself of the printing paper 9 has small irregularities, the controller 40 is capable of calculating the amount of displacement of the printing paper 9 in the width direction between the detection positions Pb and Pc while eliminating the influence of the irregularities. As a result, the relative value Rbc(t) indicating how much the printing paper 9 is displaced in the width direction between the second detection position Pb and the third detection position Pc is obtained accurately.

The controller 40 also calculates relative values Rbd(t) and Rbe(t) of the detection results from the fourth edge sensor 30*d* and the fifth edge sensor 30*e* which serve as the following downstream detectors relative to the detection result from the second edge sensor 30*b* serving as the leading downstream detector by a similar method.

Next, the controller 40 calculates the widthwise position of the printing paper 9 in each recording position, based on the obtained relative values Rab(t), Rac(t), Rad(t), Rbc(t), Rbd(t) and Rbe(t) (Step S3). In the present preferred embodiment, the relative widthwise positions of the printing paper 9 in the recording positions P2 to P4 are calculated with reference to the widthwise position of the printing paper 9 in the leading recording position P1.

Interpolations are herein performed between the relative values Rab(t), Rac(t), Rad(t), Rbc(t), Rbd(t) and Rbe(t) obtained in Step S2, based on a positional relationship between the recording positions P1 to P4 and the detection positions Pa to Pe. For example, when all of the distances between adjacent ones of the recording and detection positions (distances d1 to d8 in FIG. 2) are equal, relative widthwise positions R2(*t*), R3(*t*) and R4(*t*) of the printing paper 9 in the respective following recording positions P2, P3 and P4 relative to the widthwise position of the printing paper 9 in the first recording position P1 may be calculated by substituting the relative values Rab(t), Rac(t), Rad(t), Rbc(t), Rbd(t) and Rbe(t) obtained in Step S2 into Equations (3) to (5) below.

$$R2(t)=(Rab(t)+Rbc(t))\times 1/2 \quad (3)$$

$$R3(t)=(Rac(t)+Rbd(t))\times 1/2 \quad (4)$$

$$R4(t)=(Rad(t)+Rbe(t))\times 1/2 \quad (5)$$

Figure 6:
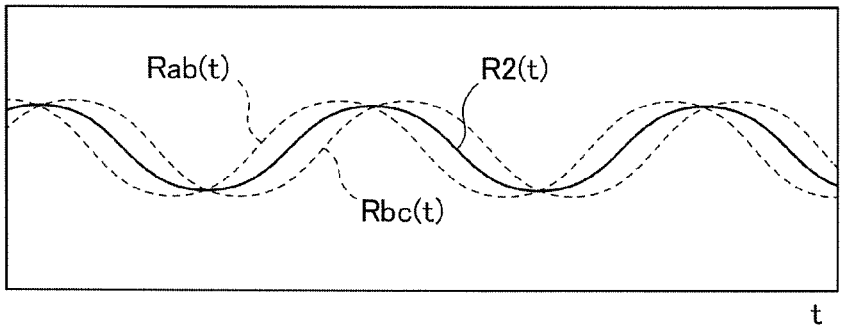
FIG. 6 is a graph showing an example of an interpolation process.

In Equation (3) above, the relative widthwise position R2(*t*) is calculated as the average value of the relative value Rab(t) related to the upstream detector for the second recording position P2 and the relative value Rbc(t) related to the downstream detector for the second recording position P2. The graph of FIG. 6 illustrates a relationship between the values Rab(t), Rbc(t) and R2(*t*) in the aforementioned calculation. In Equations (4) and (5), the relative widthwise positions R3(*t*) and R4(*t*) are similarly calculated respectively as the average values of the relative values related to the upstream detectors for the recording positions P3 and P4 and the relative values related to the downstream detectors for the recording positions P3 and P4.

In this manner, when the recording positions and the detection positions are equally spaced and arranged in alternate order, the interpolation process in Step S3 is performed with the use of simple calculations. This achieves the reduction in computational burdens on the controller 40 serving as a calculation part.

When the distances between adjacent ones of the recording and detection positions (distances d1 to d8 in FIG. 2) are not constant, the relative widthwise positions R2(*t*), R3(*t*) and R4(*t*) may be calculated by an interpolation process such as linear interpolation using the ratio between the distances. Also, the amount of computation of the controller 40 may be reduced by approximate calculation on the assumption that the ratio of distances from each recording position to the detection positions in front of and behind each recording position is constant.

In the image recording apparatus 1 according to the present preferred embodiment, the upstream detector and the downstream detector are disposed in front of and behind each of the recording positions P1 to P4 as described above. Based on the detection result from the upstream detector and the detection result from the downstream detector, the controller 40 uses the interpolation process to calculate the widthwise position of the printing paper 9 in each of the recording positions P1 to P4. In particular, the recording heads 21 to 24 according to the present preferred embodiment cover the full width of the printing paper 9, as shown in FIG. 2. This makes it difficult in terms of space to place the edge sensors 30 in the recording positions P1 to P4 themselves. However, the execution of the aforementioned process allows the identification of the widthwise positions of the printing paper 9 in the recording positions P1 to P4 without placing the edge sensors 30 in the recording positions P1 to P4 themselves.

Thereafter, the controller 40 performs the correction process, based on the calculation results in Step S3 (the relative widthwise positions of the printing paper 9 in the following recording positions P2 to P4 relative to the widthwise position of the printing paper 9 in the first recording position P1) (Step S4). In Step S4, the ejection positions of ink droplets toward the printing paper 9 in the second to fourth recording positions P2 to P4 are corrected, based on the relative positions R2(*t*), R3(*t*) and R4(*t*) obtained in Step S3. This suppresses the misregistration between the single-color images to be recorded on the printing paper 9 by the four recording heads 21 to 24.

A conventional known method may be used for the correction process in Step S4. Examples of the method include physically changing the positions of the respective recording heads 22 to 24, and correcting print data to change the nozzles 201 which eject ink droplets. When the transport rollers 12 are also present under the image recorder 20, the transport rollers 12 may be displaced in the width direction to accurately correct the widthwise position of the printing paper 9.

<3. Modifications>

While the one preferred embodiment according to the present invention has been described hereinabove, the present invention is not limited to the aforementioned preferred embodiment.

Figure 7:
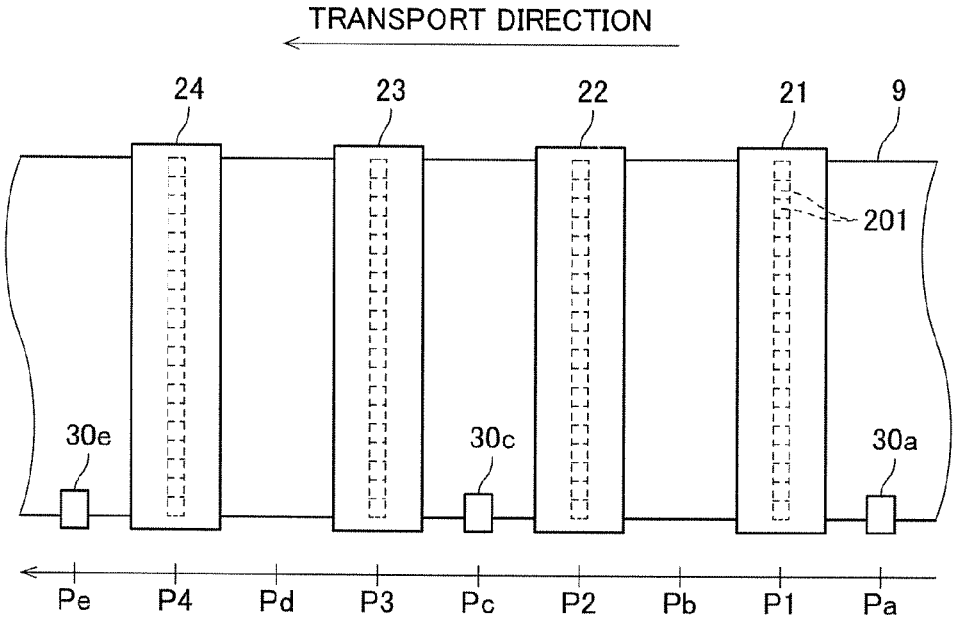
FIG. 7 is a partial top plan view of the image recording apparatus according to a modification of the present invention.

In the aforementioned preferred embodiment, the edge sensors 30 are provided upstream and downstream of all of the recording heads 21 to 24. In other words, the upstream and downstream detectors are provided for all of the four recording positions P1 to P4. However, one or more of the edge sensors 30 may be dispensed with, as shown in FIG. 7, for example. A comparison between FIGS. 2 and 7 shows that the edge sensor 30*b* in the second detection position Pb and the edge sensor 30*d* in the fourth detection position Pd are dispensed with in the example of FIG. 7.

When the amount of displacement of the printing paper 9 in the width direction is small or when required print quality is low, the widthwise position of the printing paper 9 in each of the recording positions is calculated with sufficient accuracy using linear interpolation or other various interpolation methods even if one or more of the edge sensors 30 are dispensed with in this manner.

In the aforementioned preferred embodiment, the edge sensors 30 are provided upstream and downstream of the recording heads 21 to 24. However, when there is enough space for the placement of sensors, the edge sensors 30 may be provided upstream and downstream of the nozzles 201. In this case, one of the edge sensors 30 may be provided upstream or downstream of the recording heads 21 to 24.

In the aforementioned preferred embodiment, the relative widthwise positions of the printing paper 9 in the following recording positions P2 to P4 are calculated with reference to the widthwise position of the printing paper 9 in the first recording position P1. This allows the calculation of the relative amounts of displacement of the printing paper 9 in the width direction in the plurality of recording positions without setting the widthwise reference position of the printing paper 9 in a fixed position. Also, there is no need to perform the correction process in the first recording position P1 serving as a reference. Thus, the number of correction mechanisms required is reduced.

Alternatively, the reference position may be set in a fixed position different from the recording positions P1 to P4, so that the widthwise positions of the printing paper 9 in the four recording positions P1 to P4 relative to the fixed reference position are calculated. In this case, the ejection position of ink droplets toward the printing paper 9 is required to be corrected also in the leading first recording position P1.

In FIGS. 2 and 6, the nozzles 201 are arranged in a line in the width direction in each of the recording heads 21 to 24. However, the nozzles 201 may be arranged in two or more lines in each of the recording heads 21 to 24. In this case, the controller 40 may calculate the widthwise position of the printing paper 9, for example, for each nozzle line or may determine one of the nozzle lines (e.g., the most upstream line) as a representative line to calculate the widthwise position of the printing paper 9 only in a recording position corresponding to the representative line. In the latter case, the ejection positions of ink droplets may be uniformly corrected in the representative and other lines.

In the aforementioned preferred embodiment, the transmission type edge sensors 30 are used as the upstream and downstream detectors. However, other detection methods may be used for the detection in the upstream and downstream detectors. For example, reflection type optical sensors, ultrasonic sensors and contact type sensors may be used. The upstream and downstream detectors may be sensors for detecting a portion of printing paper other than edges. For example, the sensors may be of the type which reads or scans marks on an upper surface of printing paper or the grain (direction) of fibers of the printing paper itself by means of a high-definition camera.

Although the edge sensors 30 are disposed only on one edge of the printing paper 9 in the aforementioned preferred embodiment, the sensors may be disposed in any position as seen in the width direction of the printing paper 9, such as on the other edge and in a middle portion of the printing paper 9. Alternatively, a plurality of sensors may be disposed in the width direction of the printing paper 9. When the sensors are disposed in the width direction, the widthwise positions of the printing paper 9 in the sensor positions are determined using the results of measurement in the respective sensors. An average widthwise position of the printing paper 9 may be determined, when required. Alternatively, a position between the sensors may be determined by interpolation between the results of measurement in the sensors.

In the aforementioned preferred embodiment, the four recording heads 21 to 24 are provided in the image recording apparatus 1. However, the number of recording heads in the image recording apparatus 1 may be in the range of one to three or not less than five. For example, a head for ejecting ink of a spot color may be provided in addition to those for K, C, M and Y. When only one recording head is provided, an upstream detector and a downstream detector may be disposed in front of and behind one recording position on the transport path, so that the widthwise position of recording paper in the recording position is calculated by an interpolation process, based on the detection results from the upstream and downstream detectors.

The aforementioned image recording apparatus 1 records an image on the printing paper 9 serving as a recording medium. However, the image recording apparatus according to the present invention may be configured to record an image on a sheet-like recording medium other than general paper (for example, a film made of resin, metal foil and glass). The image recording apparatus according to the present invention may be an apparatus which records an image on a recording medium by a method other than the inkjet method (for example, an electrophotographic process and exposure to light).

The components described in the aforementioned preferred embodiment and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. An image recording apparatus comprising:

a transport mechanism for transporting an elongated strip-shaped recording medium in a longitudinal direction thereof along a predetermined transport path;

at least one recording head for recording an image on a surface of the recording medium in a recording position on said transport path;

an upstream detector for detecting a widthwise position of the recording medium in a position upstream of said recording position on said transport path;

a downstream detector for detecting the widthwise position of the recording medium in a position downstream of said recording position on said transport path; and a calculation part for calculating the widthwise position of the recording medium in said recording position, based on detection results from said upstream detector and said downstream detector.

2. The image recording apparatus according to claim 1, wherein said upstream detector and said downstream detector detect changes in the widthwise position of the recording medium with time, and said downstream detector detects the widthwise position of at least a portion of the recording medium which is downstream of a portion thereof on which an image is to be recorded.

3. The image recording apparatus according to claim 1, wherein:

said at least one recording head includes a plurality of recording heads;

said recording heads include a first recording head for recording an image on the surface of the recording medium in a first recording position on said transport path, and a second recording head for recording an image on the surface of the recording medium in a second recording position downstream of said first recording position on said transport path; and said upstream detector and said downstream detector are provided for each of said first and second recording positions.

4. The image recording apparatus according to claim 3, wherein said calculation part calculates a relative widthwise position of the recording medium in said second recording position with reference to the widthwise position of the recording medium in said first recording position.

5. The image recording apparatus according to claim 4, wherein said calculation part makes a comparison between results of detection of the same portion of the recording medium which are obtained from said upstream detectors for said first and second recording positions, and makes a comparison between results of detection of the same portion of the recording medium which are obtained from said downstream detectors for said first and second recording positions, to thereby calculate said relative widthwise position.

6. The image recording apparatus according to claim 4, wherein said calculation part performs an interpolation between the detection results from said detectors, based on a positional relationship between said detectors and said recording positions, to thereby calculate said relative widthwise position.

7. The image recording apparatus according to claim 3, wherein a single sensor functioning both as said downstream detector for said first recording position and as said upstream detector for said second recording position is provided between said first recording position and said second recording position.

8. The image recording apparatus according to claim 7, wherein said sensor is positioned substantially equidistant from said first recording position and said second recording position.

9. The image recording apparatus according to claim 1, wherein said at least one recording head covers the full width of the recording medium.

10. The image recording apparatus according to claim 1, wherein said at least one recording head ejects ink droplets toward the surface of the recording medium.

11. A method of recording an image on a surface of an elongated strip-shaped recording medium in a recording position on a predetermined transport path while transporting the recording medium in a longitudinal direction thereof along the transport path, comprising the steps of:

a) detecting a widthwise position of the recording medium in a position upstream of said recording position on said transport path, and detecting the widthwise position of the recording medium in a position downstream of said recording position on said transport path; and b) calculating the widthwise position of the recording medium in said recording position, based on detection results obtained in step a).

12. The method according to claim 11, wherein:

said step a) includes the steps of a-1) detecting a change in the widthwise position of the recording medium with time in a position upstream of said recording position on said transport path, and a-2) detecting a change in the widthwise position of the recording medium with time in a position downstream of said recording position on said transport path; and the widthwise position of at least a portion of the recording medium which is downstream of a portion thereof on which an image is to be recorded is detected in said step a-2).

13. The method according to claim 11, wherein:

a first recording position and a second recording position downstream of said first recording position are present on said transport path; and in said step a), the widthwise positions of the recording medium are detected in respective positions upstream of said first and second recording positions, and the widthwise positions of the recording medium are detected in respective positions downstream of said first and second recording positions.

14. The method according to claim 13, wherein a relative widthwise position of the recording medium in said second recording position is calculated in said step b) with reference to the widthwise position of the recording medium in said first recording position.

15. The method according to claim 14, wherein a comparison is made between results of detection of the same portion of the recording medium which are obtained upstream of said first and second recording positions, and a comparison is made between results of detection of the same portion of the recording medium which are obtained downstream of said first and second recording positions, whereby said relative widthwise position is calculated in said step b).

16. The method according to claim 14, wherein an interpolation is performed between detection results in a plurality of detection positions, based on a positional relationship between said detection positions and said recording positions, whereby said relative widthwise position is calculated in said step b).

17. The method according to claim 13, wherein the widthwise position of the recording medium in the position downstream of said first recording position and the widthwise position of the recording medium in the position upstream of said second recording position are detected in the same detection position in said step a).

18. The method according to claim 17, wherein said detection position is substantially equidistant from said first recording position and said second recording position.

19. The method according to claim 11, wherein a recording head covering the full width of the recording medium records an image on the surface of the recording medium in said recording position.

20. The method according to claim 19, wherein said recording head ejects ink droplets toward the surface of the recording medium.

* * * * *